US007665607B1

(12) United States Patent
Hanan

(10) Patent No.: US 7,665,607 B1
(45) Date of Patent: Feb. 23, 2010

(54) COLLECTABLE ITEM

(75) Inventor: Rubin Hanan, Sarasota, FL (US)

(73) Assignee: Cap It Off, LLC, Sarasota, FL (US)

( * ) Notice: Subject to any disclaimer, the term of this patent is extended or adjusted under 35 U.S.C. 154(b) by 654 days.

(21) Appl. No.: 11/186,049

(22) Filed: Jul. 21, 2005

(51) Int. Cl.
*B65D 73/00* (2006.01)

(52) U.S. Cl. ..... 206/457; 215/329; 446/77

(58) Field of Classification Search ..... 206/457, 206/228, 295; 215/228, 295, 304; 81/3.09; 446/73, 77
See application file for complete search history.

(56) References Cited

U.S. PATENT DOCUMENTS

| | | | | | |
|---|---|---|---|---|---|
| 3,303,953 | A | * | 2/1967 | Frank | 215/228 |
| 5,035,324 | A | | 7/1991 | Bertrand | |
| D330,856 | S | | 11/1992 | Kidd | |
| D330,857 | S | | 11/1992 | Kidd | |
| 5,489,050 | A | * | 2/1996 | Finkiewicz et al. | 222/525 |
| 5,636,740 | A | * | 6/1997 | Finkiewicz et al. | 206/457 |
| D399,108 | S | * | 10/1998 | Koefelda | D8/38 |
| 5,896,585 | A | * | 4/1999 | Stazo | 2/209.13 |
| 5,897,027 | A | | 4/1999 | Steiner et al. | |
| D416,799 | S | | 11/1999 | Adams | |
| D419,449 | S | | 1/2000 | Adams | |
| D419,450 | S | | 1/2000 | Adams | |
| D419,880 | S | | 2/2000 | Adams | |
| 6,029,855 | A | | 2/2000 | Adams | |
| 6,047,400 | A | * | 4/2000 | Spencer | 2/9 |
| 6,237,787 | B1 | * | 5/2001 | Gallo et al. | 215/12.1 |
| D519,801 | S | * | 5/2006 | Lee | D8/38 |
| 7,189,134 | B2 | * | 3/2007 | Nugent et al. | 446/74 |
| 2005/0035080 | A1 | | 2/2005 | Romero | |

* cited by examiner

*Primary Examiner*—Mickey Yu
*Assistant Examiner*—Chun Cheung
(74) *Attorney, Agent, or Firm*—Luedeka, Neely & Graham, PC

(57) ABSTRACT

A collectable item system for attachment to a container closure device and a method for distributing collectable items. The collectable item system includes a novelty object having a cavity area therein. A retainer is disposed in the cavity area of the novelty object and is fixedly attached to the novelty object. The retainer includes a pawl edge for engaging a detent area of a container closure device.

16 Claims, 8 Drawing Sheets

COLLECTABLE ITEM

FIELD OF THE DISCLOSURE

The disclosure relates to a collectable item and in particular to collectable items attached to container closures and methods for attaching collectable items to containers.

BACKGROUND AND SUMMARY

Collectables and novelty items, especially collectable items licensed by sports teams are highly prized objects. Accordingly, consumer products manufacturers are continually using licensed products from movies, sports teams and the like to promote their products. Containers for food items and beverages may be used to distribute collectable items that are integral with the container closures. However, because of the many types of closures for food and beverage containers, collectable items must be specifically designed for each of the containers. The wide variety of container designs leads to a large inventory of collectable items of various designs that are needed for attaching to such containers.

Another disadvantage of having collectable items integral with the closure for containers is that the collectable item must be installed on the container at the time the container is filled. When the demand for the collectable item is greater or less than the demand for the product in the container, it difficult to adjust inventories of the product and collectable item as demand changes.

Accordingly, there remains a need for a simplified system for attaching and distributing collectable items on food and beverage containers that will enable more efficient distribution of the product and collectable items.

With regard to the foregoing, and other objects and advantages, the disclosure provides a collectable item system for attachment to a container closure device and a method for distributing collectable items. The collectable item system includes a novelty object having a cavity area therein. A retainer is disposed in the cavity area of the novelty object and is fixedly attached to the novelty object. The retainer includes a pawl edge for engaging a detent area of a container closure device.

In another embodiment, the disclosure provides a method for distributing collectable items. The method includes the steps of providing a collectable item comprising a miniature sports object having a cavity area therein. The collectable item is attached to a retainer so that the retainer is disposed in the cavity area of the sports item. The retainer includes a projection adjacent one end thereof for engaging a detent area of a container closure device. The sports item and retainer are engaged with the closure device of a consumer container. The consumer container containing the collectable item is then distributed to consumers.

A further embodiment of the disclosure provides a multi-part collectable item system for a beverage container. The multi-part collectable item system includes a miniature replica of a collectable object having a cavity area therein. A retainer is disposed in the cavity area of the collectable object and is attached to the collectable object. The retainer includes a pawl edge for engaging a detent area of a closure device for the beverage container.

An advantage of embodiments of the disclosure is that a system for attaching collectable items to a wide variety of containers may be provided using a relatively small inventory of collectable items. The system described herein enables a collectable item to be applied to a container for a food or beverage before or after leaving the container filling facility.

Hence, as the demand for the product or collectable item changes, inventories may be more readily adjusted to meet the changing demands since the collectable items do not have to be attached to the containers at the time the containers are filled with the products.

BRIEF DESCRIPTION OF THE DRAWINGS

Further features and advantages of exemplary embodiments disclosed herein may become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
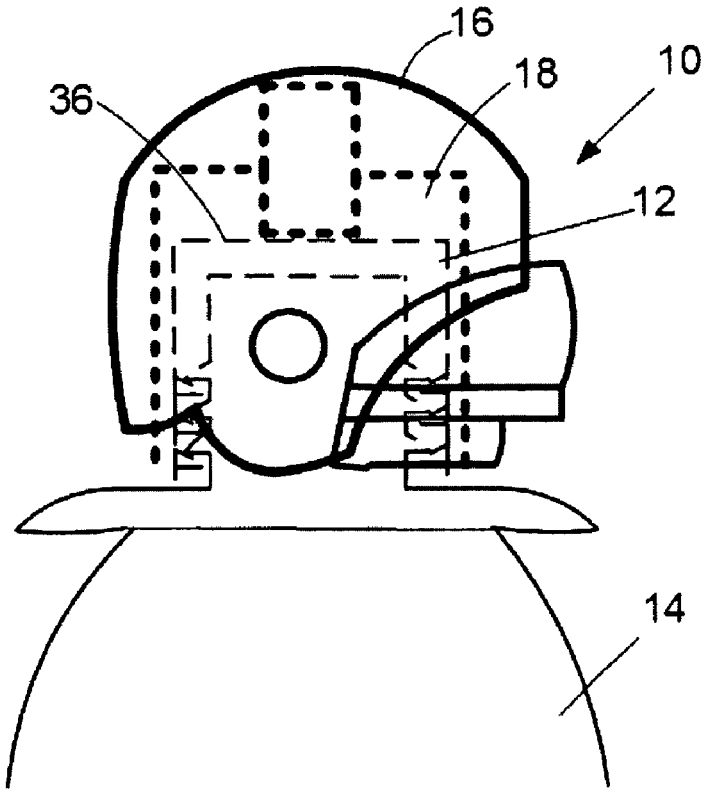
FIG. 1 is an elevational view, not to scale, of a multi-part collectable item system for containers.

With reference to FIG. 1 there is shown an assembled multi-part collectable item system 10 disposed on a closure 12 of a container 14. The system 10 includes a collectable item 16, and a retainer 18 for attachment to the container closure 12. Details of the components of the multi-part collectable item system 10 are provided in FIGS. 2-9.

Figure 2:
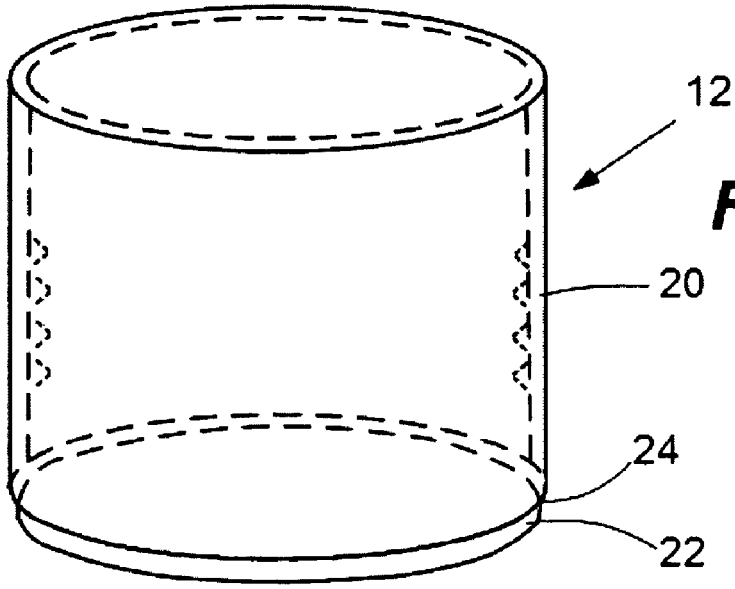
FIG. 2 is a perspective view, not to scale, of a closure for a container.

With reference to FIG. 2, there is shown in perspective view, the container closure 12 for the container 14. The container closure 12 includes a threaded side wall 20 for engaging threads on the container 14. A portion of the side wall 20 includes a detent area 22 having a ridge 24 for engagement by the retainer 18. A screw top container closure 12 is illustrated, however, the container closure 12 is not limited to a screw top closure as the retainer 18 may be adapted for attachment to a pop-off container cap wherein the retainer 18 engages an edge portion of the pop-off container cap. Accordingly, the container closure 12 may be made from a variety of materials including plastics, metals, and a combination thereof.

Figure 3:
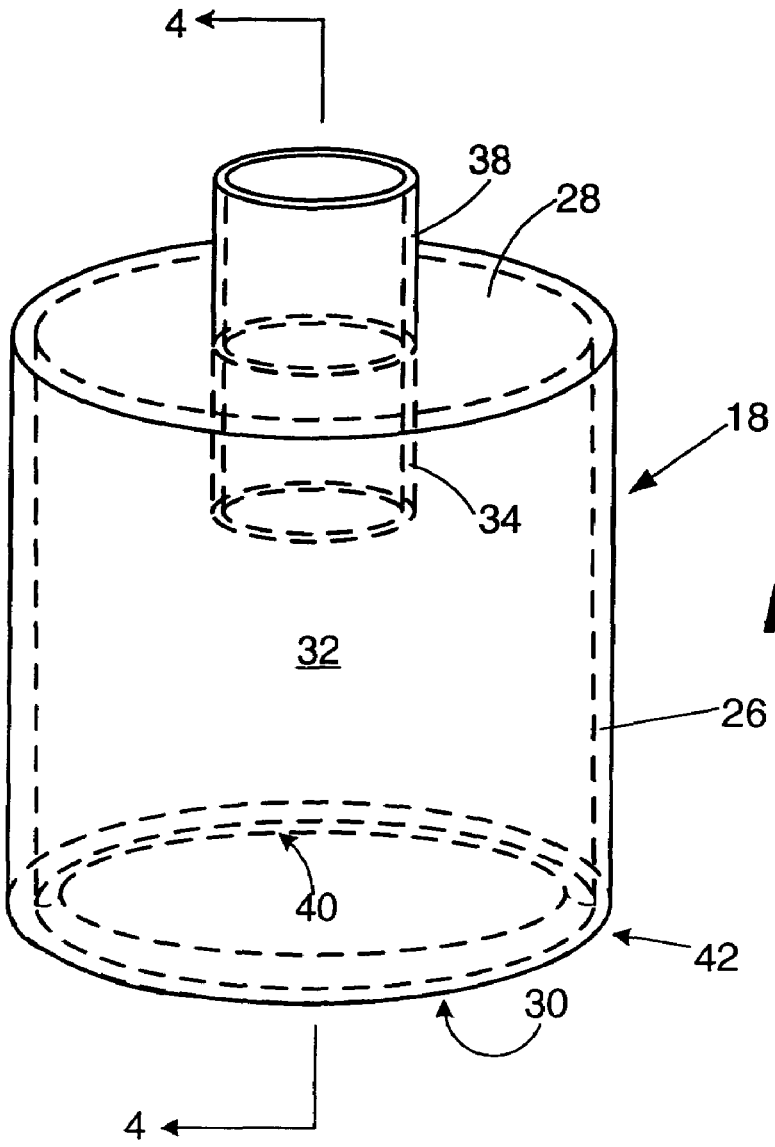
FIG. 3 is a perspective view, not to scale, of a retainer for a multi-part collectable item system for a container.

The retainer 18, illustrated in perspective view in FIG. 3, includes a side wall portion 26, an end portion 28, and an open end 30. An interior cavity area 32 of the retainer 18 may include a first spacer 34 projecting from the end portion 28.

The first spacer 34 is provided for contacting surface 36 of the container closure 12 upon attaching the retainer 18 to the container closure 12. The retainer 18 may also includes a second spacer 38 for contacting and/or attaching to an inside surface of the collectable item 16. As described in more detail below, the retainer 18 includes a pawl edge 40 for engaging the ridge 24 of the container closure 12.

Figure 4:
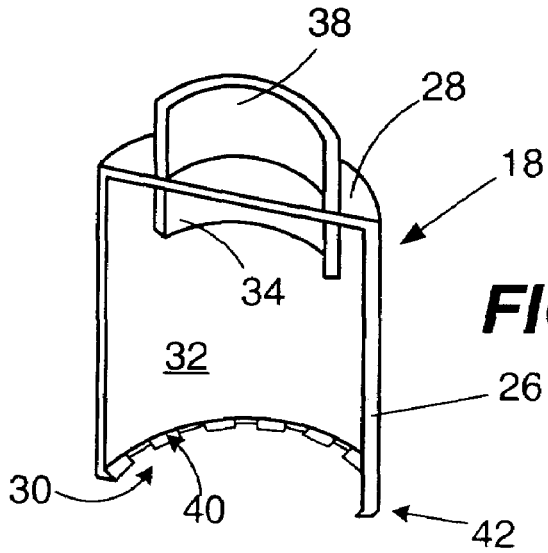
FIG. 4 is a perspective view, in cross-section, of a retainer for a multi-part collectable item system for a container.

A cross-sectional view, not to scale, of the retainer 18 is illustrated, in FIG. 4. As described above, the wall 26 includes a pawl edge 40 disposed at an end 42 thereof. The pawl edge 40 is configured to engage the ridge 24 in the detent area 22 of the container closure 12 as shown in detail in FIG. 2. The interior cavity 32 of the retainer 18 is sized to fit closely adjacent to the wall 20 of the container closure 12 so that the pawl edge 40 engages the ridge 24 thereby securing the retainer 18 to the container closure 12. The pawl edge 40 may be a continuous edge or as shown in FIG. 4, a discontinuous edge for engaging the ridge 20 of the container closure 12.

In an alternative embodiment, the retainer 18 contains no spacers 34 and 38, or contains the first spacer 34, but not the second spacer 38, or contains the second spacer 38, but not the first spacer 34. The retainer 18 may be formed from a variety of materials including plastics, metal, wood, and combinations of two or more of the foregoing. A preferred material for the retainer 18 is an injection molded plastic material.

Figure 5:
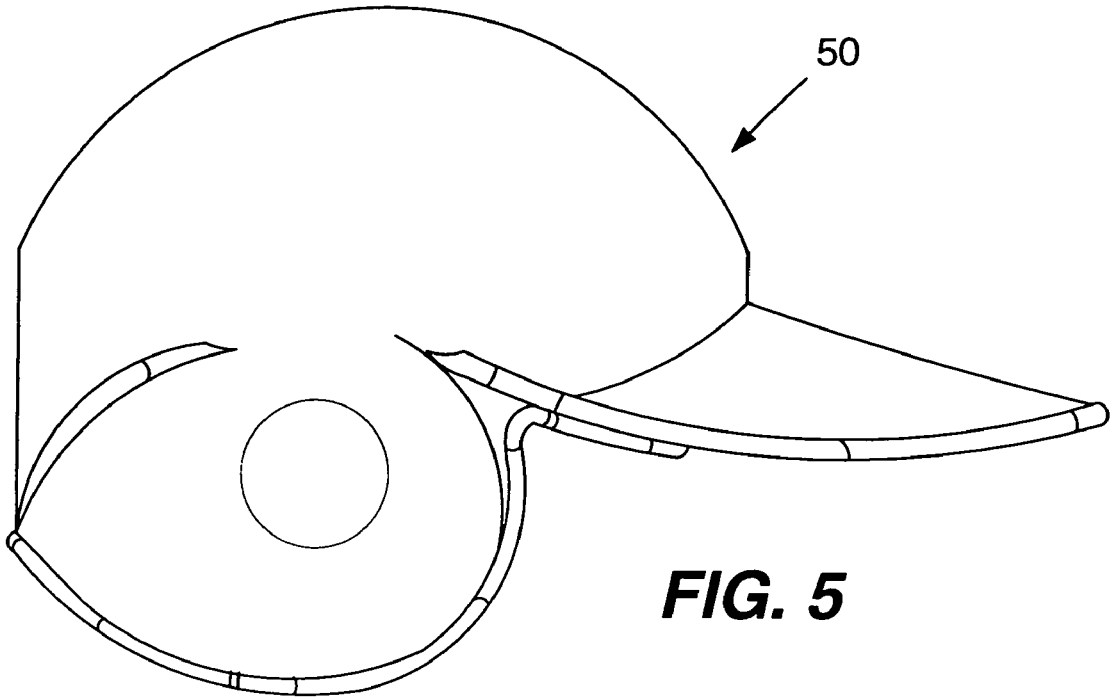
FIGS. 5 and 6 are side views, not to scale, of novelty items for a collectable item system for a container.
Figure 6:
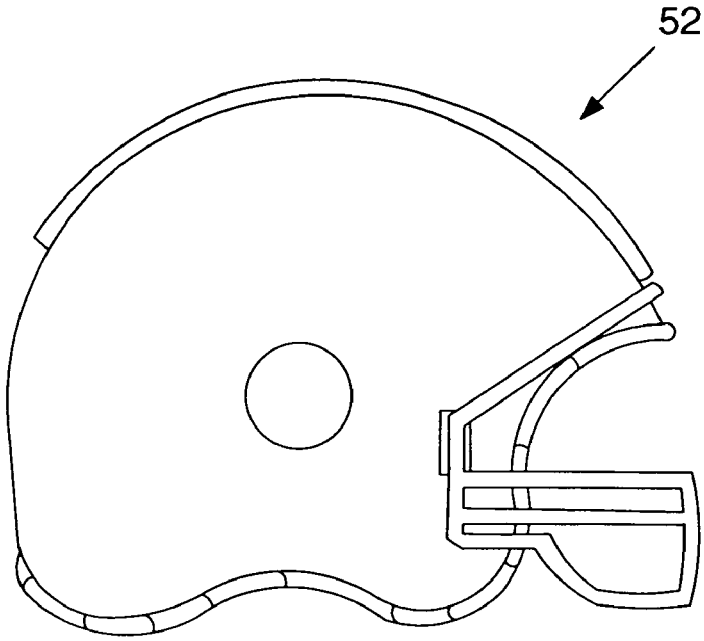
Figure 7:
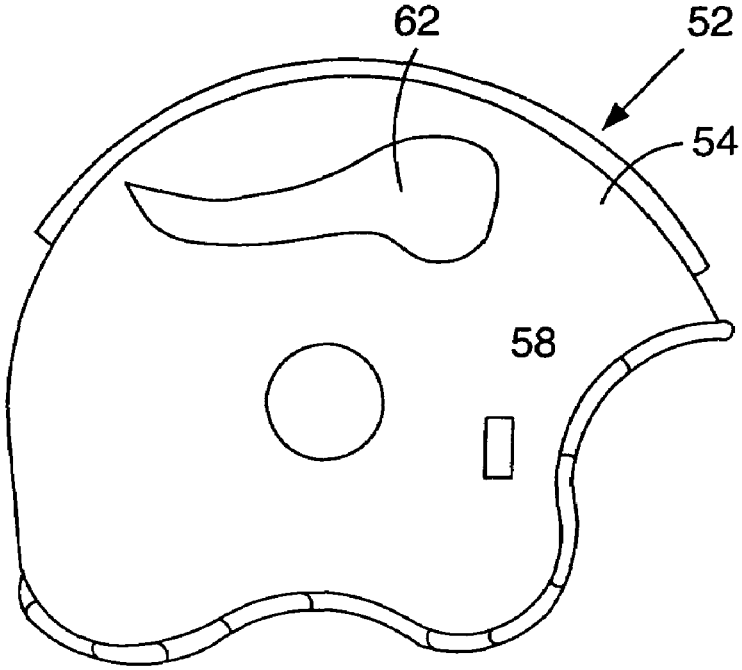
FIG. 7 is a side view, not to scale, of a portion of a novelty item for a collectable item system for a container.
Figure 8A:
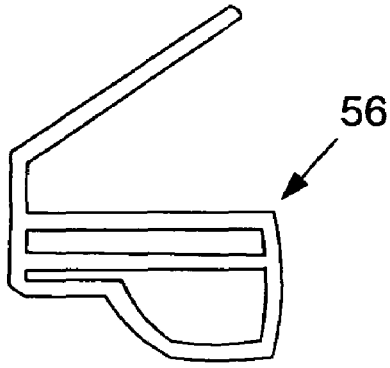
FIG. 8A is a side view and FIG. 8B is a front view, not to scale, of another portion of a novelty item for a collectable item system for a container.
Figure 8B:
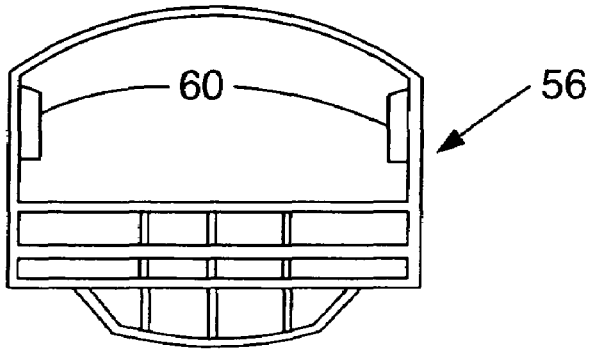

Collectable items 16 which may be distributed to customers using the multi-part collectable item system as described herein include a wide variety of novelty objects such as sports helmets, figurines, animals, sports balls, and the like. Sports helmets may include, but are not limited to, baseball helmets 50 as shown in FIG. 5, and football helmets 52 as shown in FIG. 6. The helmets 50 and 52 may be injection molded as a single piece, or as shown in FIGS. 7, 8A, and 8B, a helmet portion 54 and a separate face guard portion 56 may be provided. The helmet portion 54 includes apertures 58 therein for inserting tabs 60 (FIG. 9) of the face guard portion 56 therein. In the alternative, the face guard 56 may be adhesively attached or welded to the helmet portion 54. In order to enhance the collectability of the collectable item 14, a team logo 62 or other indicia may be attached to the helmet portion 54, or the helmet portion 54 may be colored with a team's colors.

Figure 9:
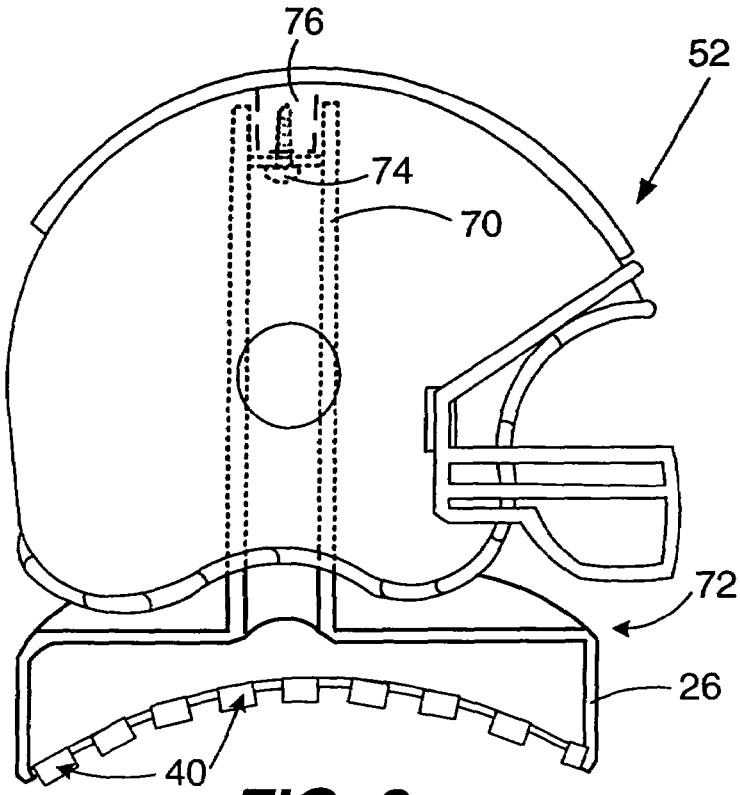
FIGS. 9-11 are side views, in partial cross-section, illustrating three different methods for attaching a retainer to a novelty object for a collectable item system for a container.

Other methods for attaching the collectable item to a retainer are illustrated in FIGS. 9-14. In FIG. 9, the helmet 52 may be fixedly or removably attached to a post 70 of a retainer 72 by a fastening device 74 such as a screw. In this embodiment, the helmet 52 includes a boss 76 for engaging the fastening device 74. The boss 76 may be molded with the helmet 52 or may be separately fixedly attached to the helmet 52 as by welding or an adhesive. Other features of the retainer 72 are similar to the features described above with reference to FIGS. 3 and 4.

Figure 10:
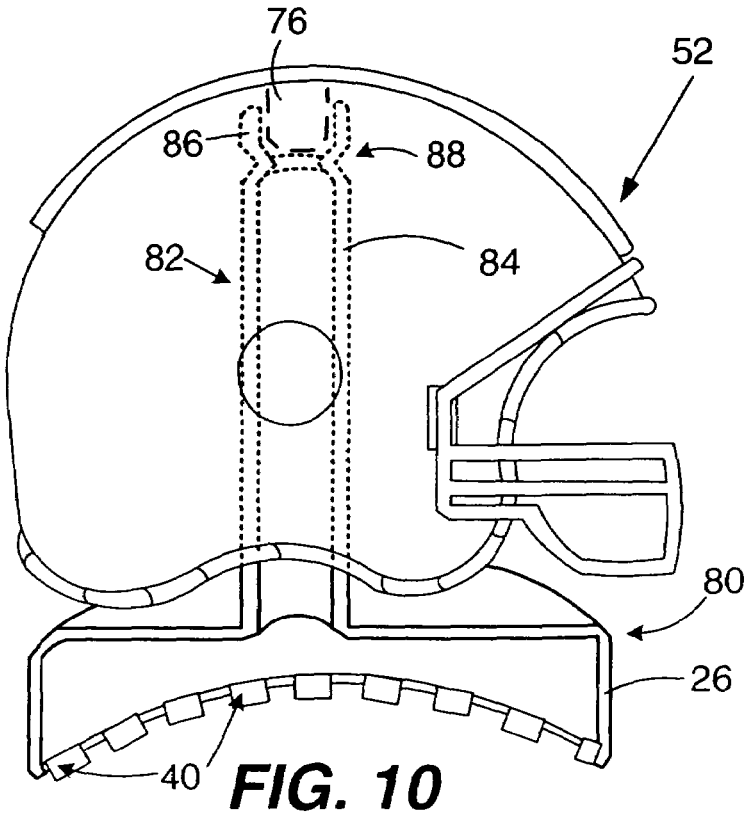

Another method for attaching the helmet 52 to a retainer 80 is illustrated in FIG. 10. In this embodiment, the retainer 80 includes a post 82 having a fixed portion 84 and a break away portion 86. The a narrowed area 88 is provided between the fixed portion 84 and the break away portion 86 to enable the helmet 52 and break away portion 86 to be separated from the fixed portion 84. In this embodiment, the break away portion 86 may be glued, welded, or otherwise fixedly attached to the boss 76.

Figure 11:
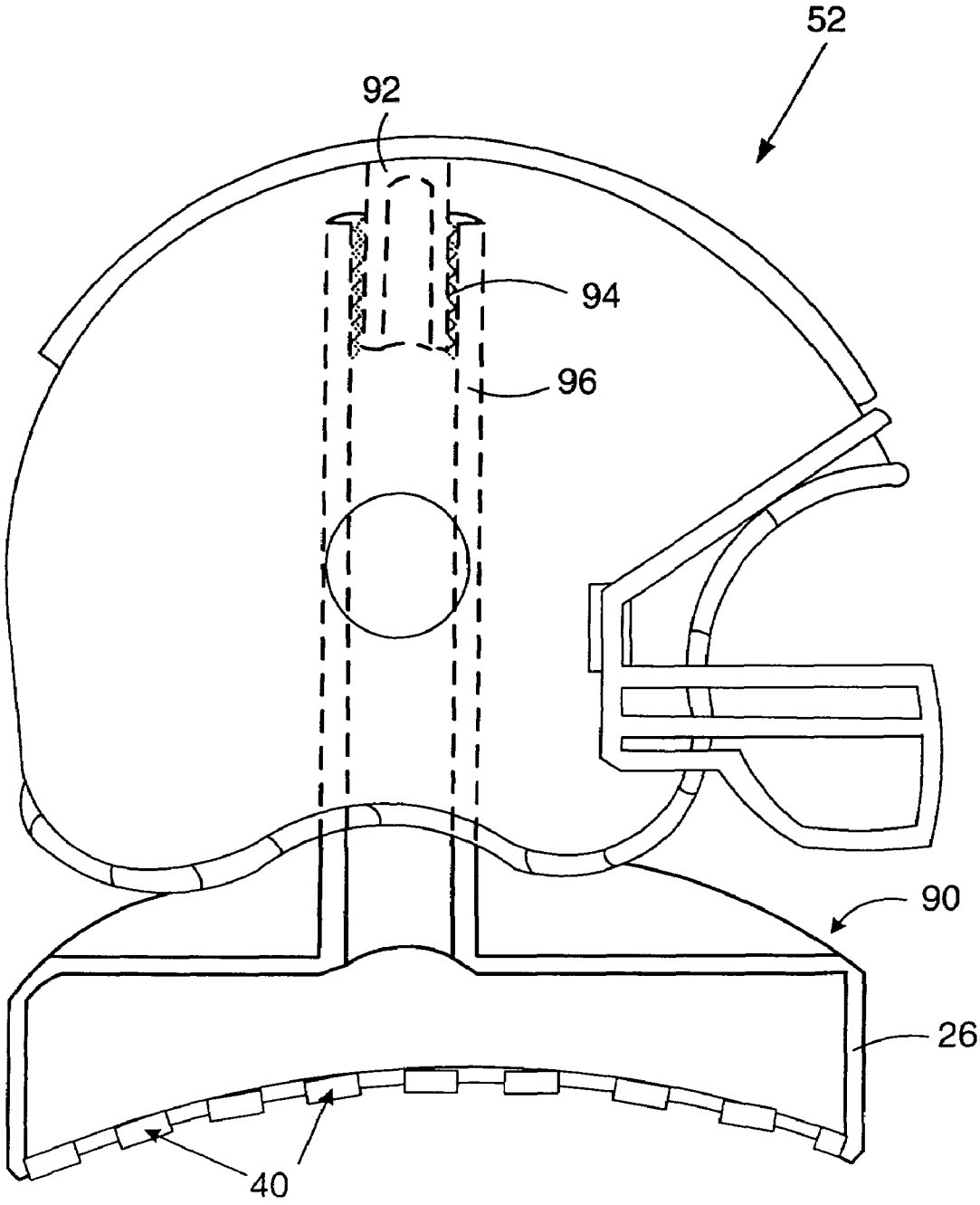

FIG. 11 illustrates another method for attaching the helmet 52 to a retainer 90. In this embodiment, the helmet contains a threaded boss 92 which is disposed to engage threads 94 on a post 96 of the retainer 90. The threaded boss 92 and post 96 may be fixedly attached to one another as be an adhesive or welding after the boss 92 and post 96 are threaded together, or the boss 92 and post 96 may be removably attached to one another.

Figure 12:
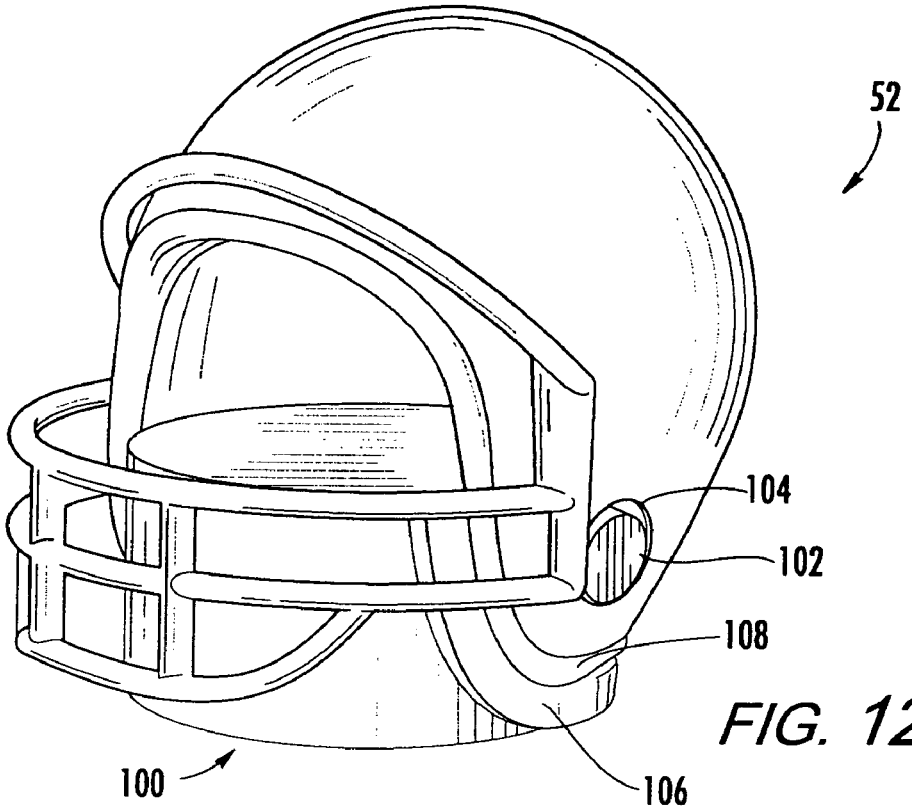
FIG. 12 is a perspective view of a novelty object and retainer illustrating a fourth method for attaching the retainer to the novelty item.
Figure 13:
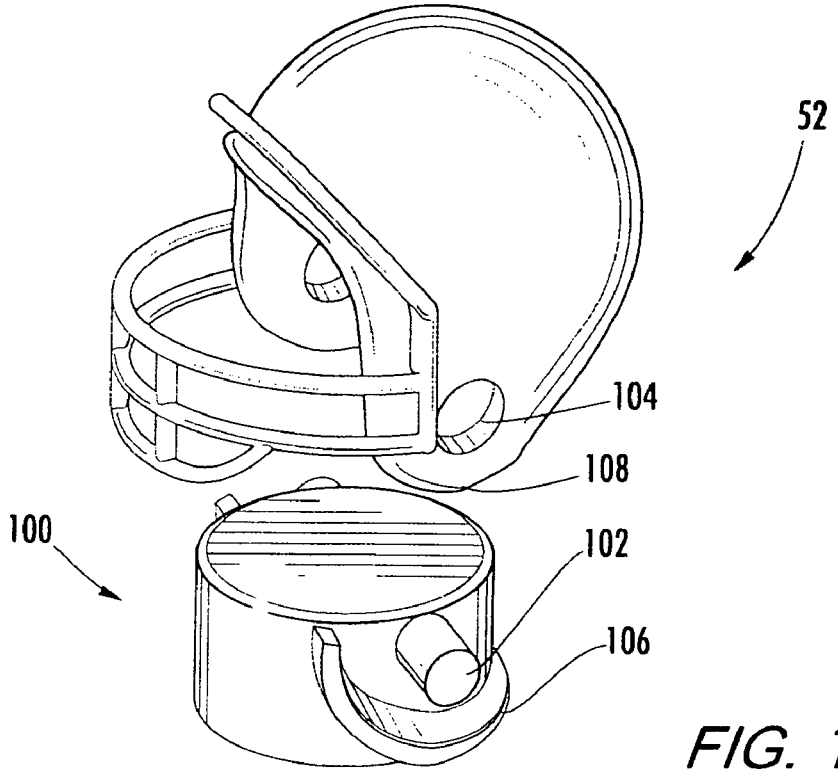
FIG. 13 is an exploded, top perspective view, not to scale, of a novelty object and retainer according to the fourth method for attaching the retainer to the novelty item.
Figure 14:
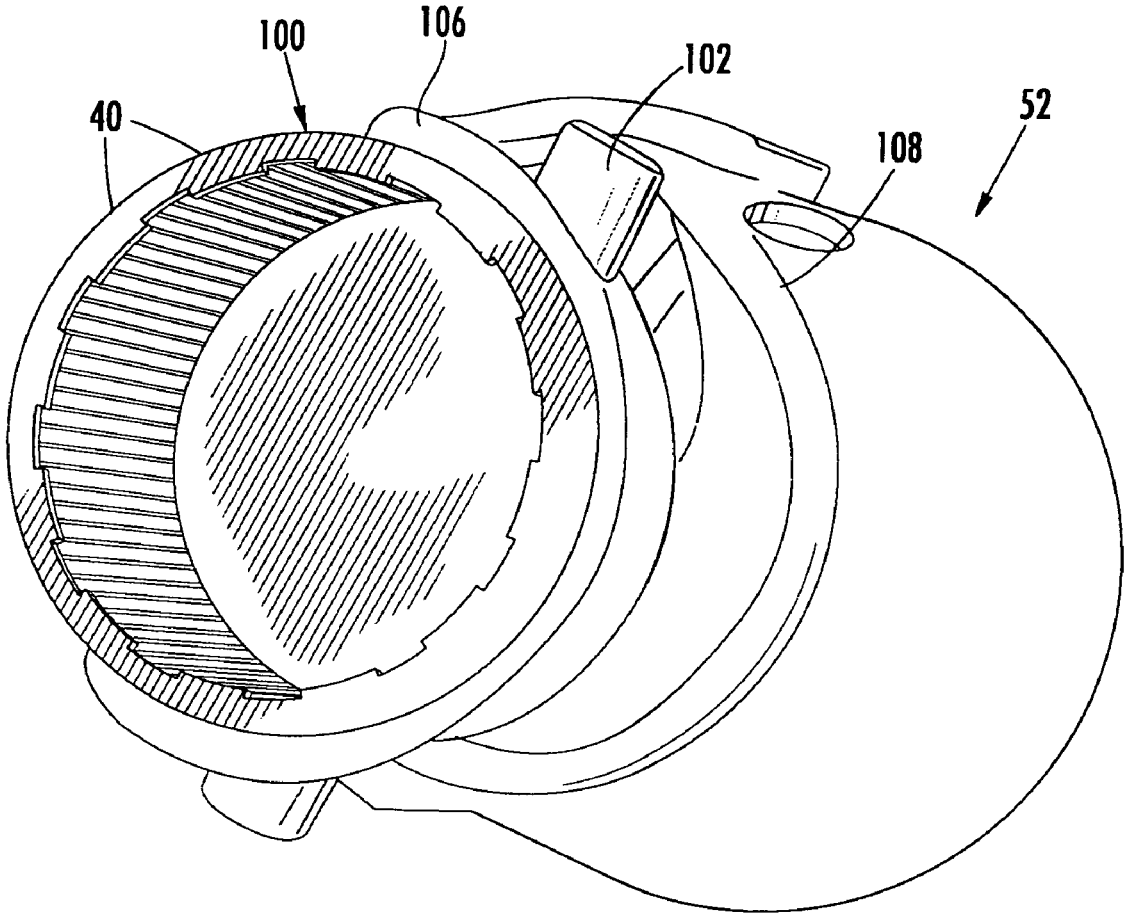
FIG. 14 is an exploded, bottom perspective view, not to scale, of a novelty object and retainer according to the fourth method for attaching the retainer to the novelty item

Yet another method for attaching the helmet 52 to a retainer 100 is illustrated in FIGS. 12-14. In this embodiment, the retainer 100 includes ears 102 for engaging apertures 104 in the helmet 52. A cradle 106 may be provided to engage a rim 108 of the helmet 52 to maintain the helmet 52 in a substantially fixed position relative to the retainer 100 as shown in FIG. 12. As described above, the retainer 100 may be injection molded to contain the ears 102 and cradle 106.

Having described various aspects and exemplary embodiments of the disclosure and several advantages thereof, it will be recognized by those of ordinary skills that the exemplary embodiments are susceptible to various modifications, substitutions and revisions within the spirit and scope of the appended claims.

What is claimed is:

1. A collectable item system for attachment to a container closure device, the collectable item system comprising a novelty object having a cavity area therein, a retainer disposed in the cavity area of the novelty object and attached to the novelty object, and a first spacer for the retainer disposed between the novelty object and the retainer in an upward orientation away from the retainer and closure device, wherein the retainer includes a pawl edge disposed adjacent an outside perimeter of the retainer for engaging a detent area of a container closure device, wherein the detent area is disposed around an outside perimeter of the container closure device.

2. The collectable item system of claim 1, wherein the novelty object is selected from the group consisting of football helmets, baseball helmets, hockey helmets, baseball caps, sports balls, and the like.

3. The collectable item system of claim 2, wherein the novelty object comprises a football helmet.

4. The collectable item system of claim 3, wherein the football helmet comprises a face guard snappingly affixed to the helmet.

5. The collectable item system of claim 1, wherein the novelty object includes a team logo.

6. The collectable item system of claim 1, wherein the novelty object is fixedly attached to the retainer.

7. The collectable item system of claim 1, wherein the novelty object is removably attached to the retainer.

8. The collectable item system of claim 1, wherein the system comprises a second spacer projection disposed in a downward orientation on an opposite side of the retainer between the retainer and the container closure device.

9. A multi-part collectable item system for a beverage container comprising a miniature replica of a collectable object having a cavity area therein, a retainer disposed in the cavity area of the collectable object, and a first spacer disposed on the retainer in an upward orientation away from the retainer and a closure device for the beverage container between the retainer and collectable object, wherein the retainer includes a pawl edge disposed adjacent an outside perimeter of the retainer for engaging an edge portion or ridge of the closure device for the beverage container to secure the retainer to the closure device, wherein the edge portion or ridge of the closure device is disposed around an outside perimeter of the container closure device.

10. The multi-part collectable item system of claim 9, wherein the collectable object comprises a sports object selected from the group consisting of football helmets, baseball helmets, hockey helmets, baseball caps, sports balls, and the like.

11. The multi-part collectable item system of claim 10, wherein the sports object comprises a football helmet.

12. The multi-part collectable item system of claim 11, further comprising a face guard snappingly affixed to the helmet.

13. The multi-part collectable item system of claim 9, wherein the sports object includes a team logo.

14. The multi-part collectable item system of claim 9, wherein the collectable object is fixedly attached to the retainer.

15. The multi-part collectable item system of claim 9, wherein the collectable object is removably attached to the retainer.

16. The multi-part collectable item of claim 9, wherein the retainer includes a second spacer projection disposed in a downward orientation on an opposite side of the retainer between the retainer and the closure device.

* * * * *

UNITED STATES PATENT AND TRADEMARK OFFICE

CERTIFICATE OF CORRECTION

PATENT NO. : 7,665,607 B1
APPLICATION NO. : 11/186049
DATED : February 23, 2010
INVENTOR(S) : Rubin Hanan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1131 days.

Signed and Sealed this

Seventh Day of December, 2010

David J. Kappos

David J. Kappos
*Director of the United States Patent and Trademark Office*